US006735828B2

(12) United States Patent
Kaneko

(10) Patent No.: US 6,735,828 B2
(45) Date of Patent: May 18, 2004

(54) BELT CONNECTOR

(75) Inventor: Hitoshi Kaneko, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/279,317

(22) Filed: Oct. 23, 2002

(65) Prior Publication Data

US 2003/0079320 A1 May 1, 2003

(30) Foreign Application Priority Data

Oct. 25, 2001 (JP) ..... 2001-327820

(51) Int. Cl.[7] ..... A44B 11/26; F16B 45/00

(52) U.S. Cl. ..... 24/615; 24/614; 24/265 EC; 24/265 BC

(58) Field of Search ..... 24/316, 318, 323, 24/625, 629, 265 H, 265 EC, 265 BC, 265 AL, 614, 615, 165

(56) References Cited

U.S. PATENT DOCUMENTS 4,577,374 A * 3/1986 Lii ..... 24/165
4,680,837 A * 7/1987 Rubinstein ..... 24/601.2
4,858,954 A * 8/1989 Escaravage ..... 24/601.2
5,146,657 A * 9/1992 Frano ..... 24/265 H
5,274,887 A * 1/1994 Fudaki ..... 24/265 H
5,471,716 A * 12/1995 Takahashi ..... 24/615
5,566,428 A * 10/1996 Takahashi ..... 24/265 H
6,226,844 B1 * 5/2001 Lerra et al. ..... 24/625
6,317,940 B1 * 11/2001 Matoba et al. ..... 24/600.9
6,513,207 B2 * 2/2003 Uehara et al. ..... 24/615
2003/0033697 A1 * 2/2003 Hicks et al. ..... 24/615

FOREIGN PATENT DOCUMENTS

JP 07-208440 8/1995
JP 2000-083709 3/2000

* cited by examiner

*Primary Examiner*—Robert J. Sandy
(74) *Attorney, Agent, or Firm*—Bell, Boyd & Lloyd LLC

(57) ABSTRACT

An accommodating portion (13) is formed at the center of a body (8) of a first member (1) having a belt attachment (10). The accommodating portion (13) has an opening (14) on the front and back sides thereof, the opening (14) being sufficient for molding a bulging head (42) of the rotary shaft (40) therein, a groove (15) sufficient for molding a neck portion (41) of the rotary shaft (40) is provided at the center of the lower side of the opening, and a concave groove (22) capable of molding a part of the neck portion (41) is formed in lateral direction. The rotary shaft (40) is integrated with the second member (2) at an upper side of a body (9) thereof and has an insert hole of an insert-type male body at a lower side. Since a gap is generated between the first member and the second member during the molding process and movement thereof becomes shaky, a retainer (34) having a bearing (35) at a distal end thereof is fitted between the bulging head (42) of the rotary shaft and the lower side (23) of the accommodating portion (13) to prevent shaky movement.

17 Claims, 17 Drawing Sheets

BELT CONNECTOR

BACKGROUND OF THE INVENTION

1. Field of the Invention

The present invention relates to a fastening such as a buckle for a belt used as a baby-nursing band, belt adjuster and a swivel hook, the fastening being used as a belt connector with a belt being attached to an end thereof.

2. Description of Related Art

Conventionally, a buckle 100 shown in FIG. 18 is known, the buckle being used for baby-nursing band. The buckle 100 shown in Japanese Patent Laid-Open Publication No. 2000-83709 has a belt connecting member 110, a male-female connector (a female member 120 and a male member 130) and a rotary mechanism 140 for freely rotating the belt connecting member 110 and the male-female connector, so that a baby-nursing band 150 is not twisted.

Another belt connector 200 shown in Japanese Patent Laid-Open Publication No. Hei 7-208440 has, as illustrated in FIG. 19, an integrally molded belt attachment 210 and an engaging member 220 using synthetic resin for strengthening connection therebetween.

When such buckles are used as a baby-nursing band, an adult initially puts a baby on the baby-nursing band, lifts the baby together with the baby-nursing band and connects the buckle to attach the baby-nursing band onto the body for holding the baby. At this time, though the band is felt unpleasant when twisted, it is troublesome to re-connect the buckle while holding a baby. Accordingly, it has been desired that a twist of a baby-nursing band can be easily fixed.

In order to eliminate the twist of the buckle, the buckle 100 shown in FIG. 18 has been proposed. In the buckle 100, in order to connect the belt connecting member 110 and the male-female connector (120, 130), a bearing 111 of the belt connecting member 110 is fitted to a rotary shaft 121 projecting on the female member 120 and a C-shaped snap ring 123 is pushed into a groove 122 of the rotary shaft 121. However, the C-shaped snap ring 123 may be damaged when a strong tension is applied to the belt 150 and, once damaged, the belt connecting member 110 comes off the rotary shaft 121 of the female member 120, thereby losing its function.

On the other hand, since the belt attachment 210 and the engaging member 220 of the belt connector 200 shown in FIG. 19 is integrally molded by injection molding means, the belt connector 200 is not easily damaged. However, since the belt attachment 210 and the engaging member 220 is molded by integral injection, a gap is generated between the belt attachment 210 and the engaging member 220 on account of die structure thereof, thus causing shakiness of the belt connector 200.

SUMMARY OF THE INVENTION

A primary object of the present invention is to provide a belt connector capable of eliminating shakiness by the gap between a first member and a second member of the belt connector generated for integrally molding the first member and the second member in a rotatable manner.

A belt connector according to an aspect of the present invention has: a first member (1) having a first body (8) provided with an accommodating portion (13) for accommodating a rotary shaft (40); and a second member (2) having a second body (9) from which the rotary shaft is projected, at least one of the first member and the second member being provided with a belt attachment (10), the first member and the second member being connected in a rotatable manner, in which the first member and the second member are integrally molded so that the rotary shaft does not come off from the accommodating portion, and a retainer (34) for restricting relative movement of the first member and the second member in axial direction of the rotary shaft is attached to the rotary shaft.

According to the above arrangement, the gap between the first and the second member can be eliminated by the retainer, so that rotary movement can be conducted smoothly without causing shakiness between the two members, thus improving the quality of the fastening.

In the present invention, the retainer (34) may preferably be fitted to the rotary shaft (40) where the rotary shaft (40) is exposed between the first member (1) and the second member (2).

According to the above arrangement, the shakiness between the two members can be effectively eliminated with a simple construction by fitting the retainer to the rotary shaft exposed between the first member and the second member.

In the present invention, the rotary shaft (40) may preferably have a neck portion (41) and a bulging head (42) formed at a distal end of the neck portion, and the retainer (34) may preferably be located between the lower side of the bulging head and the inner circumference of the accommodating portion (13) facing the lower side of the bulging head.

According to the above arrangement, the retainer can be arranged so that the gap between the first member and the second member can be most effectively blocked, thus improving the durability against external force such as tension and twist with a simple construction and preventing damage thereof.

In the present invention, the retainer (34) may preferably be formed in a bearing (35) having semicircular distal end.

According to the above arrangement, the bearing as the retainer can be easily and securely held to the rotary shaft contained in the accommodating portion from front and back sides thereof, so that the shakiness between the two members can be prevented and stability of the belt connector can be enhanced.

In the present invention, a cover (26) for concealing the rotary shaft (40) in the accommodating portion (13) may preferably be fitted to the accommodating portion (13).

According to the above arrangement, the rotary shaft exposed from the accommodating portion can be concealed by the cover and the damage on the rotary shaft and the retainer and deterioration of the rotation of the rotary shaft on account of invasion of dust can be prevented.

In the present invention, the accommodating portion (13) may preferably have an opening (14) opening to the front and back sides of the first body (8), the opening being covered with a pair of covers (26).

According to the above arrangement, the cover for concealing the rotary shaft can be located in the most suitable arrangement and the rotary shaft inside the accommodating portion can be securely covered from two directions, thereby improving appearance of the product.

In the present invention, the pair of covers (26) may preferably be of identical shape.

According to the above arrangement, since the pair of covers are of identical shape, inventory management and assembly work of the cover can be facilitated.

In the present invention, the belt attachment (10) may preferably have a belt attachment hole (11), the belt attachment hole being provided with a concave portion (17) intercommunicating with the accommodating portion (13), and the cover (26) may preferably be fitted to the concave portion so that the rotary shaft (40) is accommodated therein.

According to the above arrangement, the rotary shaft can be securely and easily concealed by the cover and the rotary shaft inside the accommodating portion can be securely concealed from one direction, thereby improving appearance thereof.

In the present invention, the retainer (34) and the cover (26) may preferably be integrally molded to be connected.

According to the above arrangement, since the retainer and the cover are integrally molded to be connected, the number of the components and production cost can be reduced and the assembly efficiency can be improved.

In the present invention, the retainer (34) may preferably be formed in a bearing (35) having a slit (36) on a part thereof.

According to the above arrangement, the bearing as the retainer can be easily and securely fitted to the rotary shaft inside the accommodating portion or between the first and the second members, so that the shakiness between the first and the second members can be eliminated and the stability of the belt connector can be enhanced.

In the present invention, the retainer (34) may preferably have a rotation-stop projection (37), the rotation-stop projection capable of being fitted to a groove (15) provided to the accommodating portion.

According to the above arrangement, the retainer can be stably attached to the rotary shaft, thereby facilitating attachment of the retainer.

In the present invention, a thick portion (44) may preferably be provided on the second body (9) by thickening a base (43) of the second body (9) from which the rotary shaft (40) is projected.

According to the above arrangement, since the thick portion is provided on the base of the body from which the rotary shaft is projected, the diameter of the rotary shaft can be increased, thereby increasing the strength of the rotary shaft and preventing damage thereon.

In the present invention, the belt attachment (10) may preferably be provided on either one of the first member (1) and the second member (2), and a third member (3) capable of attachment and detachment through an engaging mechanism may preferably be provided on the other, the third member being provided with another belt attachment (54).

According to the above arrangement, since the second member and the third member are arranged as a male member and a female member, the components can be easily applied to a male-female buckle type fastenings.

In the present invention, the belt attachment (10) may preferably be provided on either one of the first member (1) and the second member (2), and wherein the other is made of a swivel hook (6).

According to the present invention, the components can be easily applied to a swivel hook type fastenings including a belt attachment and a swivel hook.

In the present invention, a mechanism for adjusting belt length may preferably be provided on either one of the first member (1) and the second member (2).

According to the above arrangement, the components can be easily applied to the belt adjuster as a connector.

In the present invention, a bulging portion (60) having arc-shaped periphery may preferably be formed on an inner circumference of a hole (11) for a belt to be inserted, so that the hole for the belt to be inserted has wider space on both sides thereof and narrow space at the central portion thereof.

According to the above arrangement, in inserting a belt, an end of a belt is inserted from a side of the bulging portion (60), i.e. from a portion having larger space, and is directly drawn out to the opposite side. After the distal end, the intermediate portion of the drawn-out belt is guided to the portion having narrower space along the arc-shaped periphery at the distal end of the bulging portion (60). As a result, inserting work of the belt can be facilitated and the belt can be securely engaged to the belt attachment without twisting the belt.

DETAILED DESCRIPTION OF PREFERRED EMBODIMENT(S)

Embodiments of belt connector of the present invention will be described below with reference to attached drawings.

In the following embodiments, the belt connector of the present invention is applied to fastenings such as a male-female buckle 5, swivel hook 6 and a belt adjuster 7.

[First Embodiment]

Figure 1:
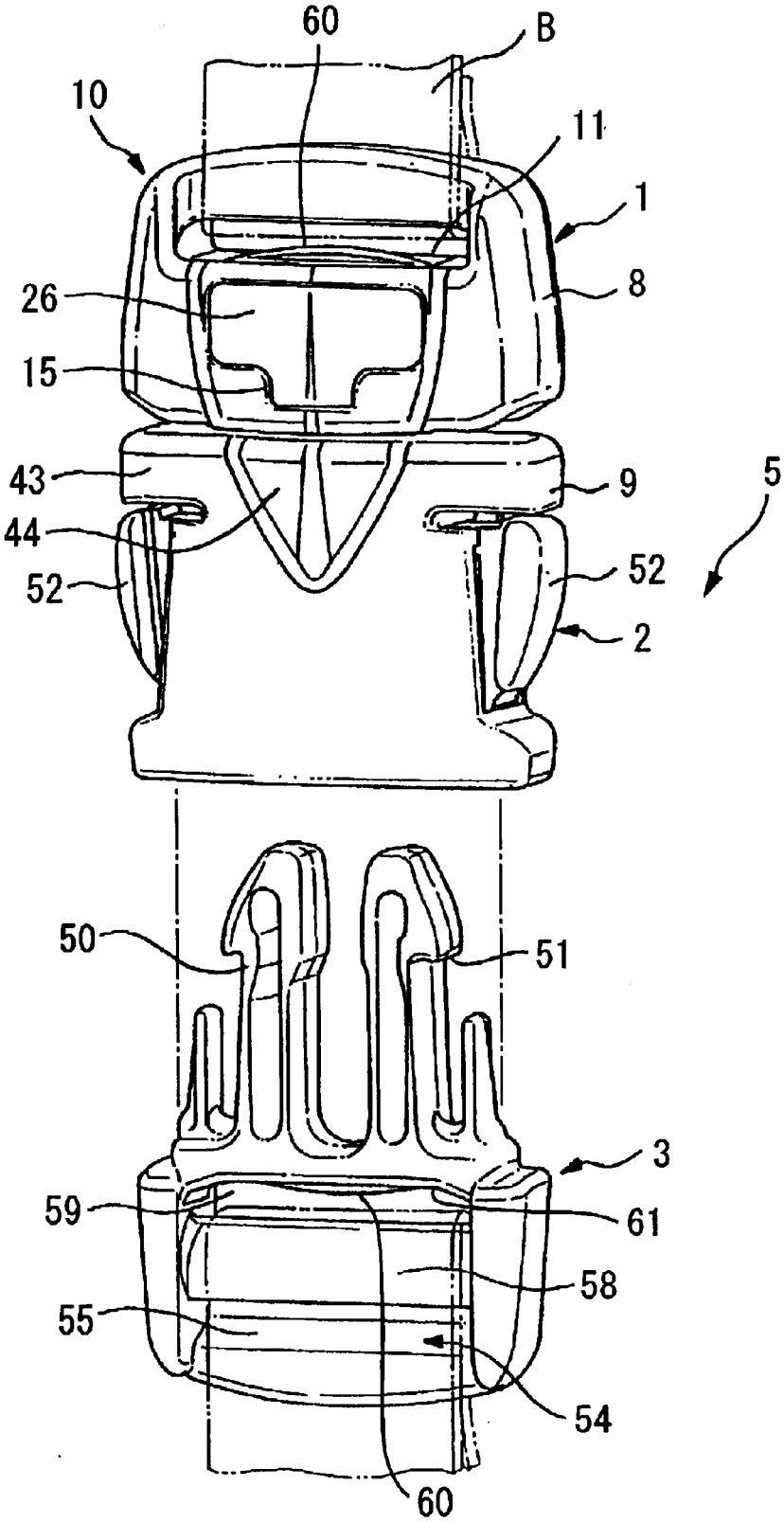
FIG. 1 is a perspective view of a male-female buckle according to first embodiment of the present invention.

FIGS. 1 to 6 shows a male-female buckle 5 applied with a belt connector according to first embodiment of the present invention. As shown in FIG. 1, the belt connector has a flat body 8 as a first member 1 having a belt attachment 10 for attaching a belt B, a female body as a second member 2 and a third member 3 capable of being attachable and detachable relative to the second member 2 and having an insert leg 50 to be inserted to the second member 2 and a belt engaging portion 54 as another belt attachment. The body 8 of the first member 1 has an accommodating portion 13 composed of an accommodating space 19 having an opening 14 opened to front and back thereof for accommodating a rotary shaft 40 of the second member 2, the accommodating portion 13 having a slit 18 at the center of the lower side thereof for inserting the rotary shaft 40 projected on a body 9 of the second member 2. The opening 14 provided on the front and back side of the accommodating portion 13 is shaped in reverse T-shape. A concave groove 15 penetrates the center of the lower side of the accommodating portion 13 in front and back direction. On both sides 20 of the accommodating portion 13, engaging projections 16 for engaging an engaging piece 27 of a cover 26 for closing the opening 14 is provided in vertically alternate manner.

Figure 4:
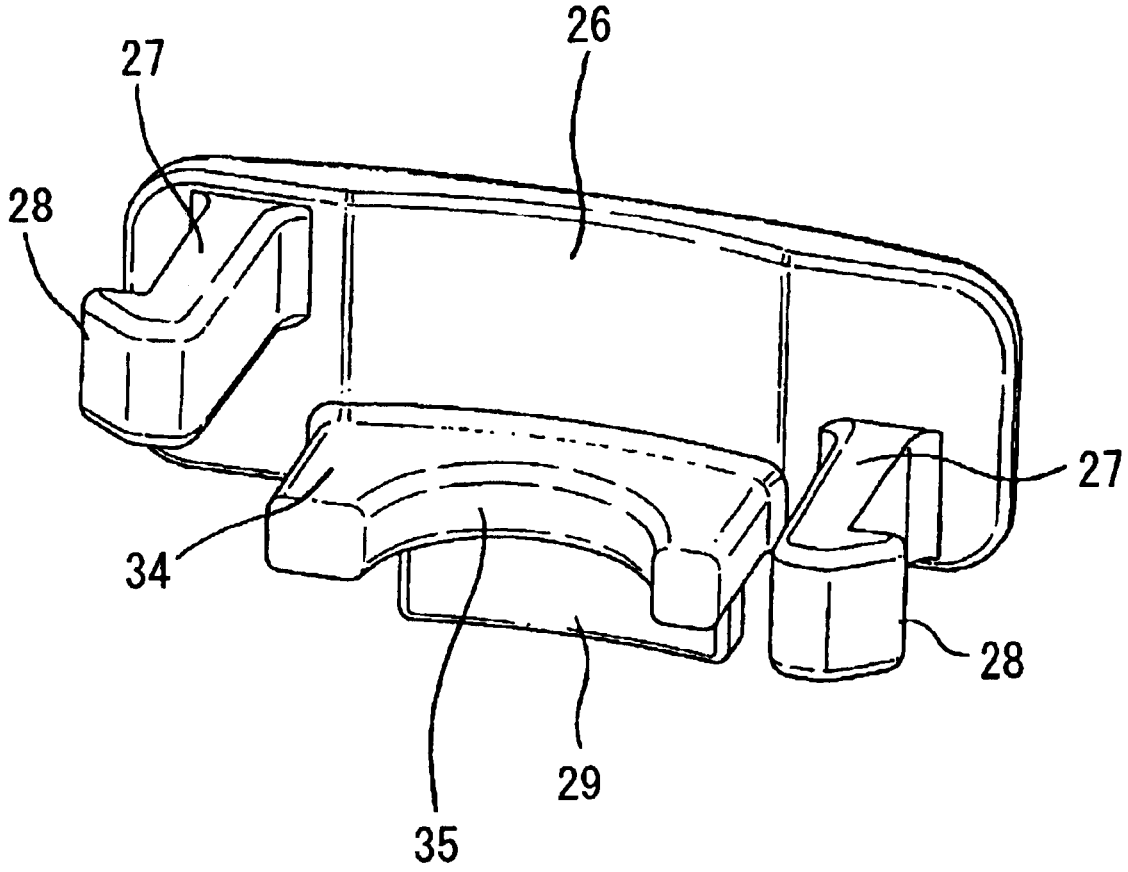
FIG. 4 is a perspective view showing an integrally molded cover and a retainer of the belt connector.

As shown in FIG. 4, the cover 26 for closing the opening 14 is a reverse T-shaped plate body, which has a fitting projection 29 at the center thereof projecting downward to be fitted to the groove 15 of the accommodating portion 13. A bearing 35 projecting inward and having a semi-circular distal end is provided above the fitting projection 29 to form the retainer 34. The cover 26 and the retainer 34 are integrally molded, so that the bearing 35 holds the rotary shaft 40 from front and back sides when two covers 26 are fitted to the front and back openings 14. The engaging pieces 27 are provided on both sides of the inner side of the cover 26 in a vertically alternate manner. An engaging claw 28 projecting in a hook shape toward outside is provided on the distal end of the engaging piece 27 to be engaged with the engaging projection 16.

A belt attachment hole 11 for attaching the belt B is provided on the upper side of the accommodating portion 13 of the body 8 and a belt attachment bar 12 is provided on the outside of the belt attachment hole 11 to form the belt attachment 10. After an end of the belt B to be attached is inserted into the belt attachment hole 11, the belt is fixed by, for instance, sewing the end of the belt B after being wound around the belt attachment bar 12.

On the other hand, the body 9 of the female-body as the second member 2 has flat cylindrical shape, which has the projecting rotary shaft 40 having cylindrical neck portion 41 at the center of the upper side of a base 43. A bulging head 42 is formed at the distal end of the neck portion 41, which prevents detachment of the first member 1 relative to the second member 2. A thick portion 44 slightly projecting toward surface direction and narrowing toward the inserting portion of the male body is provided on the base 43 from which the rotary shaft 40 of the body 9 is provided to reinforce the rotary shaft 40.

The first member 1 and the second member 2 may be integrally molded by an injection molding machine using thermoplastic resin such as polyacetal, polyamide, polypropylene and polybutylene terephthalate. During the injection molding process, cores are inserted to the opening 14 of the accommodating portion 13 from back and front sides and a concave groove 22 extending in right and left direction is provided between a pair of horizontal bars 24 at the lower side of the accommodating portion 13, to which cores are inserted from both sides thereof, so that the rotary shaft 40 composed of the neck portion 41 and the bulging head 42 are molded, the bulging head 42 preventing the first member 1 and the second member 2 from being fallen off.

Figure 2:
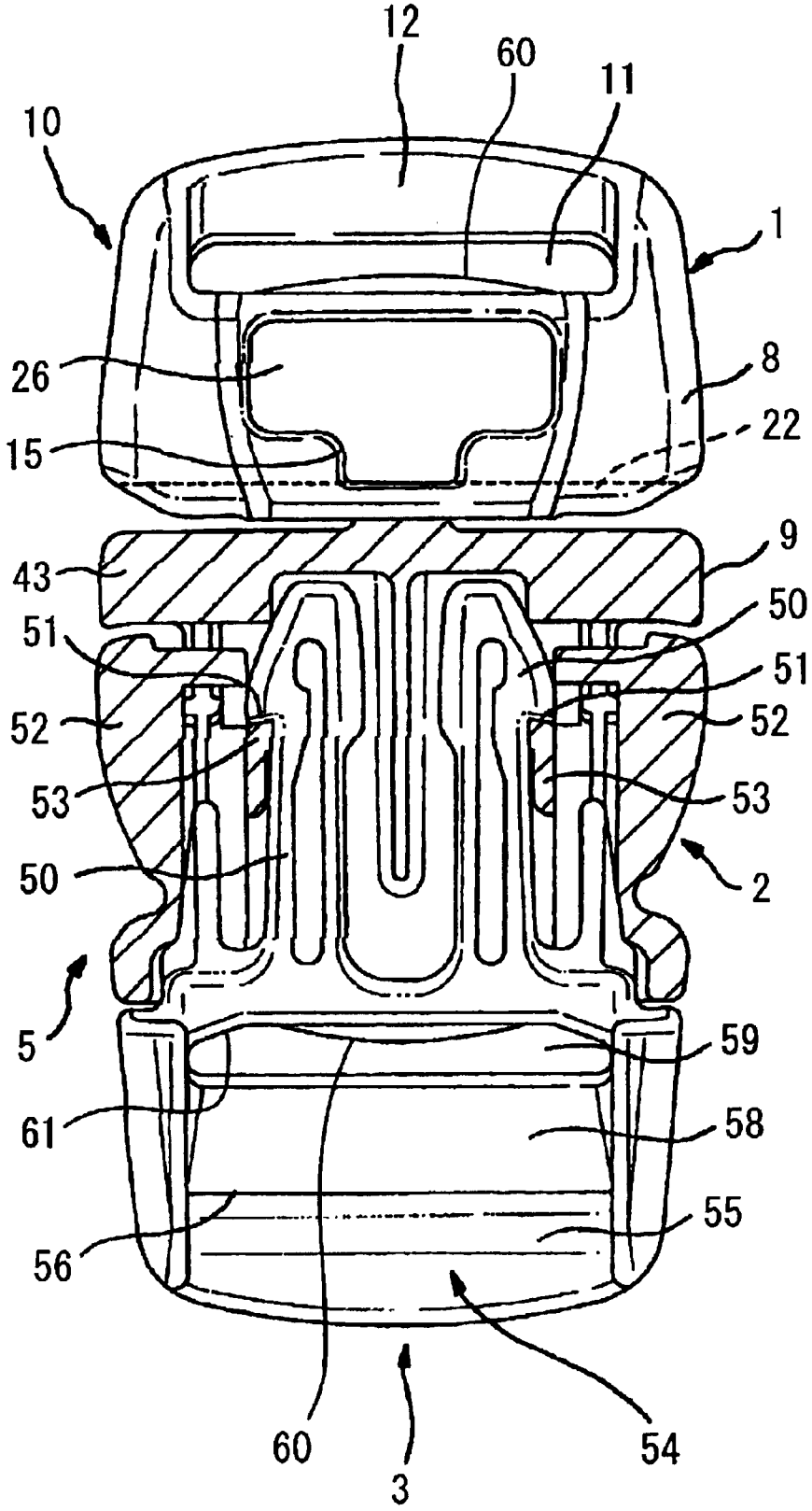
FIG. 2 is a partly sectioned front elevational view of the belt connector.

Incidentally, the shape of the female body of the second member 2 and the male body of the third member 3 may be designed in any manner as long as the male-female buckle 5 having conventionally known attachment and detachment mechanism can be formed. As an instance, the female body has elastic press pieces 52 on both sides thereof and engaging portions 53 opposing the press piece 52 inside the female body as shown in FIGS. 1 and 2. A belt engaging portion 54 to which the belt B is inserted and fixed for adjusting the length of the belt B is provided on one side of the male body of the third body 3 and an insert leg 50 to be inserted to the female body is formed on the other side, a hook-shaped engaging projection 51 being provided on an outer distal end of the insert leg 50 to be engaged with the engaging portion 53. The belt engaging portion 54 has a belt insert hole 59 at the center of the third member 3, a hook bar 58 for hooking the belt adjacent to the belt insert hole 59, an engaging bar 55 opposing the hook bar 58 for engaging the belt, and a engaging hole 57 provided between the engaging bar 55 and the hook bar 58 for the belt to be inserted to adjust the length of the belt. Incidentally, the shape of the female body of the second member 2 and the male body of the third member 3 may be designed as a male-female buckle having differently shaped attachment-detachment mechanism.

Figure 3:
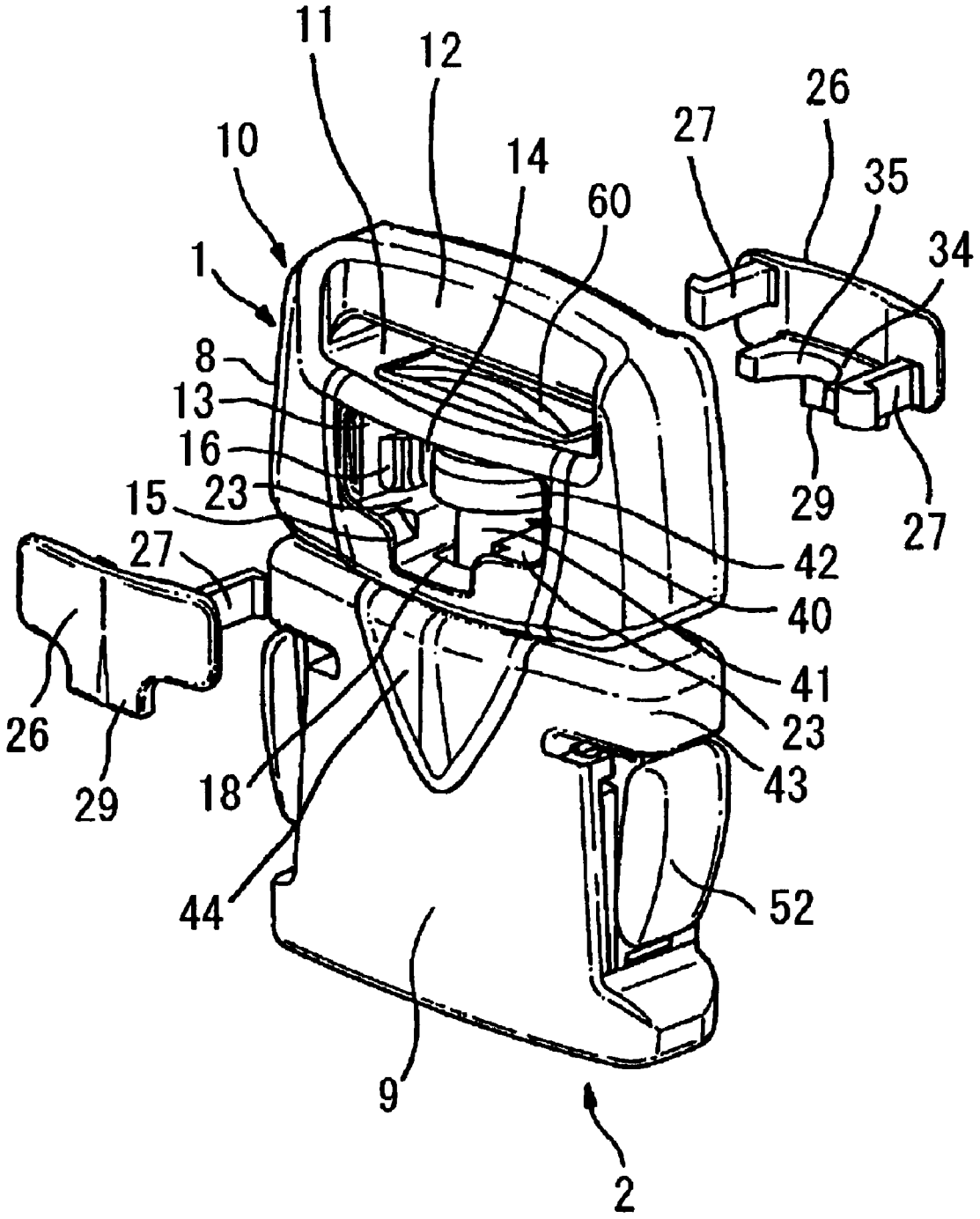
FIG. 3 is a perspective view showing a first member and a second member of the belt connector.
Figure 5:
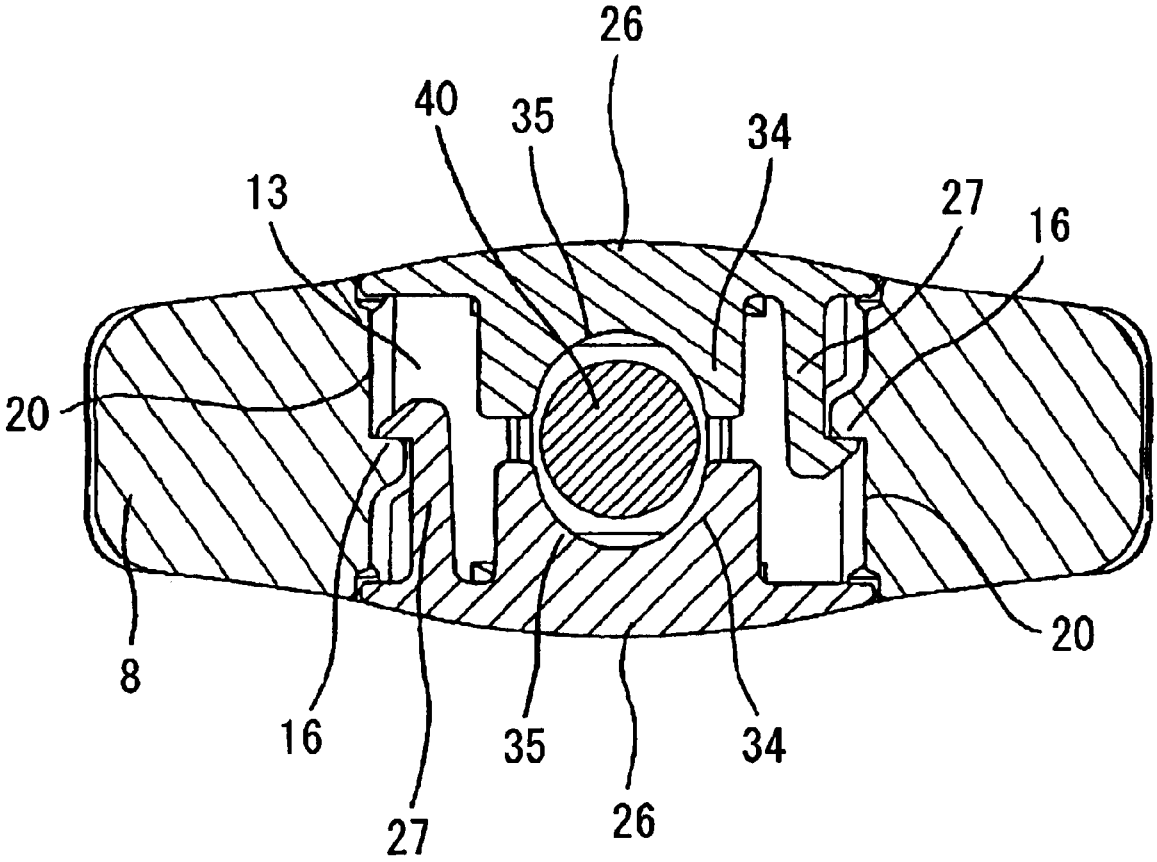
FIG. 5 is a lateral cross section of the first member of the belt connector.
Figure 6:
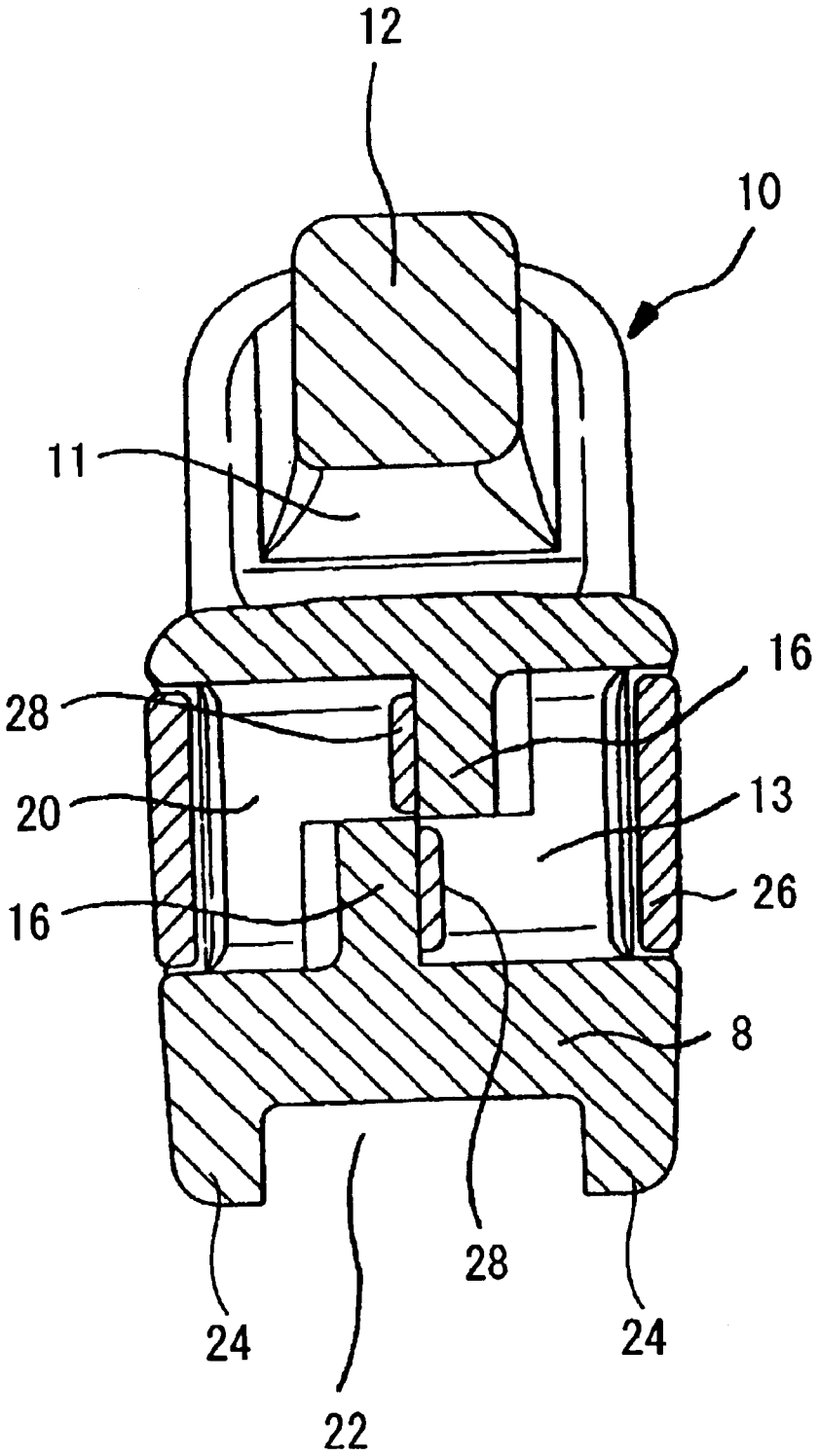
FIG. 6 is a longitudinal cross section of the first member of the belt connector.

The first member 1 and the second member 2 are integrally injection-molded so that the first member 1 is fitted to the rotary shaft 40 projecting from the second member 2. When the both members 1 and 2 are injection-molded, a gap is generated between the members 1 and 2 on account of the thickness of the core inserted thereto, thereby causing shaky movement. In order to prevent the vertical movement of the first member 1 relative to the rotary shaft 40 to eliminate the shakiness, the bearing 35 as the retainer 34 integrated with the cover 26 is fitted between the bulging head 42 on the rotary shaft 40 and the lower side 23 of the both sides of the groove 15 of the accommodating portion 13 as shown in FIG. 3. As shown in FIGS. 5 and 6, the cover 26 is fitted to the opening 14 from the front and back sides of the accommodating portion 13 provided on the body 8 of the first member 1 and the engaging claw 28 of the engaging piece 27 is engaged with and fixed on the engaging projection 16 on the sidewall of the accommodating portion 13 to prevent the vertical movement of the first member relative to the rotary shaft 40 and to conceal the rotary shaft 40 to produce a belt connector with good appearance.

As shown in FIG. 2, a bulging portion 60 for facilitating the insertion of the belt B and secure engagement is formed on the belt attachment 10 of the first member 1 and the belt engaging portion 54 of the third member 3.

The arc-shaped bulging portion 60 bulging toward the inside of the belt attachment hole 11 is formed on the side of the belt attachment hole 11 opposite to the side for the belt B to be drawn out, i.e. on the inner circumference on the side of the second member 2. The space of the belt attachment hole 11 is wide on both sides of the bulging portion 60 and is narrow at the center where the bulging portion 60 is the most prominent. Accordingly, when the belt B is inserted to the belt attachment hole 11, the belt B is initially inserted from the side of the bulging portion 60, i.e. from the portion of wide space, and is drawn out to the opposite side. The intermediate part of the drawn-out belt B succeeding the distal end is guided to the narrow-spaced part along the arc-shaped periphery of the bulging portion 60. As a result, the belt B can be easily inserted, and the belt B inserted to the belt attachment hole 11 can be prevented from being twisted on account of the narrow part of the hole, and securely fixed to the belt attachment 10.

The arc-shaped bulging portion 60 bulging toward the inside of the belt insert hole 59 is formed on a side of the belt insert hole 59 opposite to the side for the belt B to be drawn out, i.e. on the inner circumference on two sides of the second member 2. The space of the belt insert hole 59 is wide on both sides of the bulging portion 60 and is narrow at the center where the bulging portion 60 is the most prominent. Accordingly, insertion can be facilitated and engagement can be securely conducted in the belt insert hole 59 as in the belt attachment 10 of the first member 1.

Further, the outer part of the inner circumference of the belt insert hole 59 of the belt engaging portion 54 relative to the both ends of the bulging portion 60 is a slant surface 61 extending toward the end of the bulging portion 60. The presence of the slant surface 61 facilitates the movement of the belt B toward the center of the bulging portion 60 when the distal end of the belt B is inserted, thus further securely attaching the belt B.

Incidentally, on both of the belt attachment 10 and the belt engaging portion 54, a flat surface corresponding to original inner circumference of the belt attachment hole 11 or the belt insert hole 59 is formed along front and back side of the bulging portion 60, i.e. along the opening of the belt attachment hole 11 or the belt insert hole 59, so that the insertion of the belt B is facilitated even when the distal end of the belt B hits the central part of the inner circumference of the belt insert hole where the bulging portion 60 is located.

[Second Embodiment]

Figure 7:
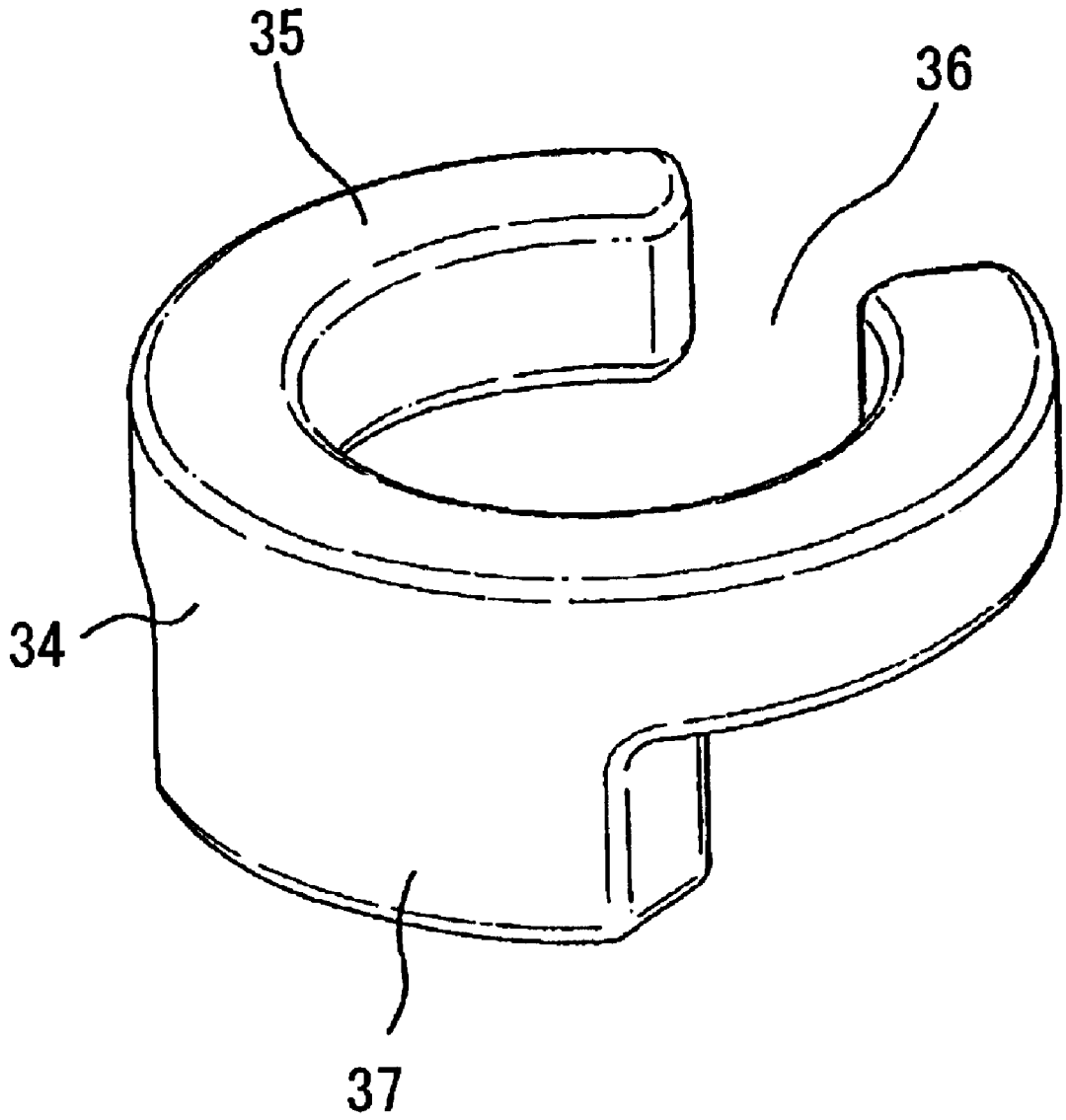
FIG. 7 is a perspective view showing a retainer of a belt connector according to a second embodiment of the present invention.

The belt connector according to second embodiment of the present invention shown in FIGS. 7 to 10 is the same as the above first embodiment except that the cover 26 and the retainer 34 are independent. As shown in FIG. 7, the retainer 34 is formed in a C-shaped bearing 35 by forming a slit 36 at a part of a ring to be fitted to the rotary shaft 40. A rotation-stop projection 37 extending downward is provided on the opposite side of the slit 36 to be fitted to the groove 15 formed on the accommodating portion 13 in a concave fashion.

Figure 8:
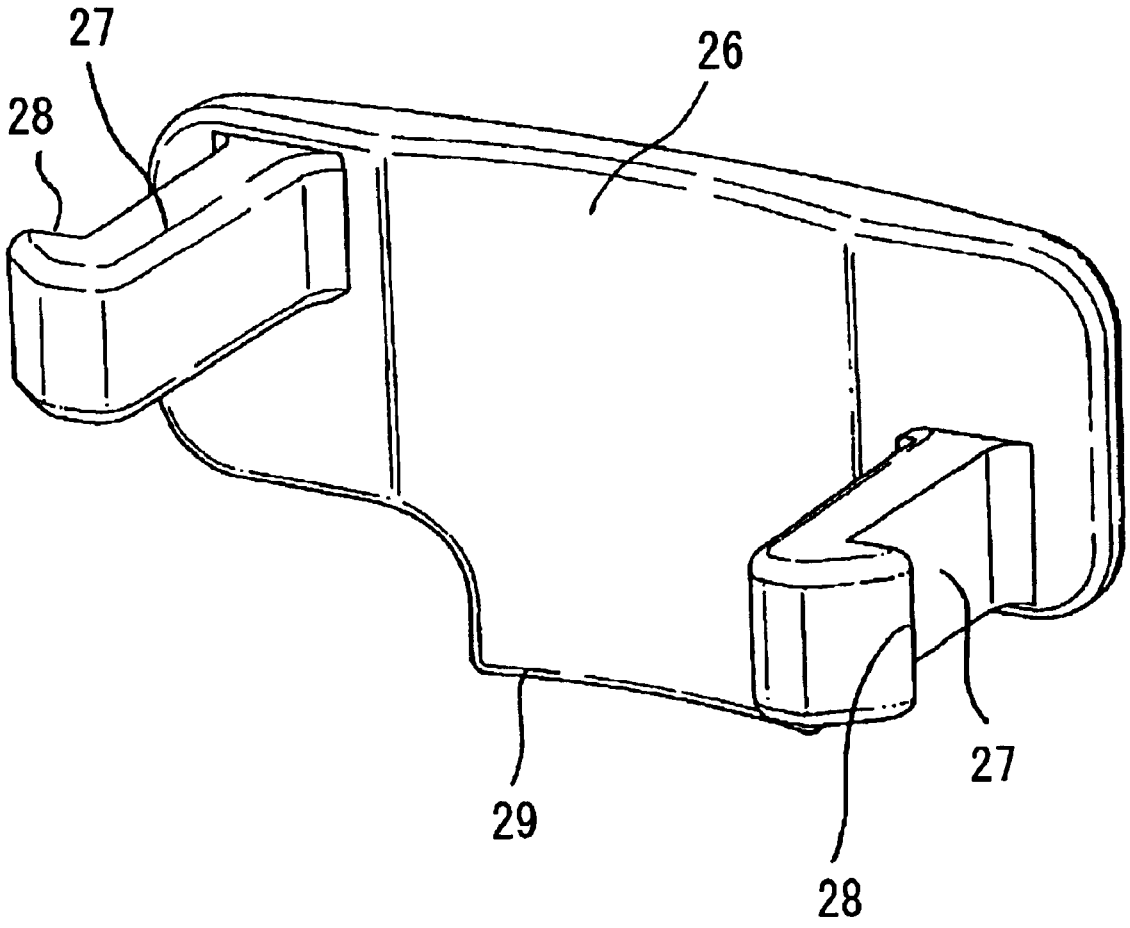
FIG. 8 is a perspective view showing a cover of the belt connector.

On the other hand, as shown in FIG. 8, the cover 26 has the engaging pieces 27 on both sides of a flat plate of approximate T-shape provided in a vertically alternate manner, outside-facing engaging claws 28 being provided on the distal end of the engaging piece 27 to be engaged with the engaging projection 16 provided on the sidewall 20 of the accommodating portion 13.

Figure 9:
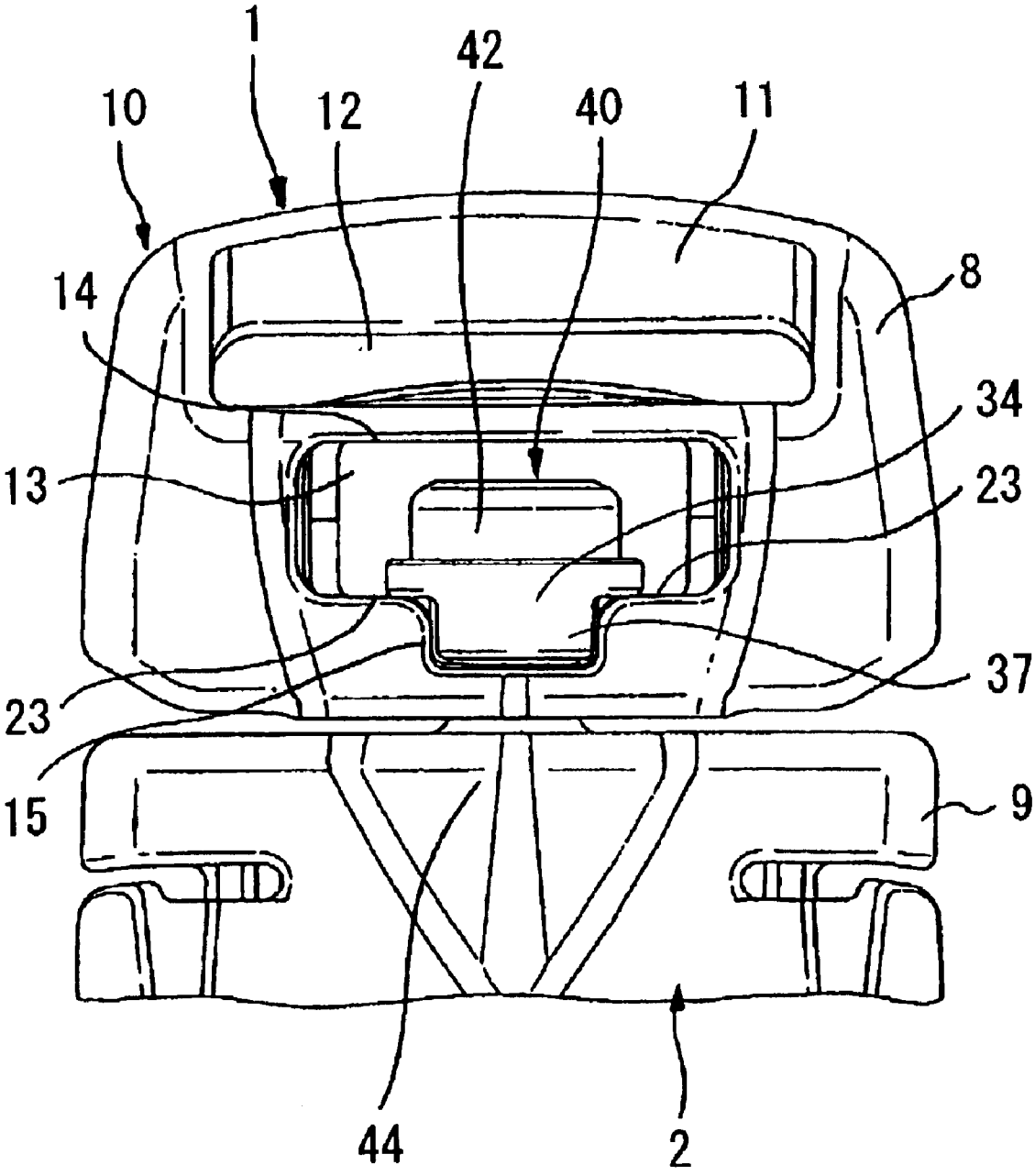
FIG. 9 is a front elevational view showing a primary portion of the belt connector with the cover being removed.
Figure 10:
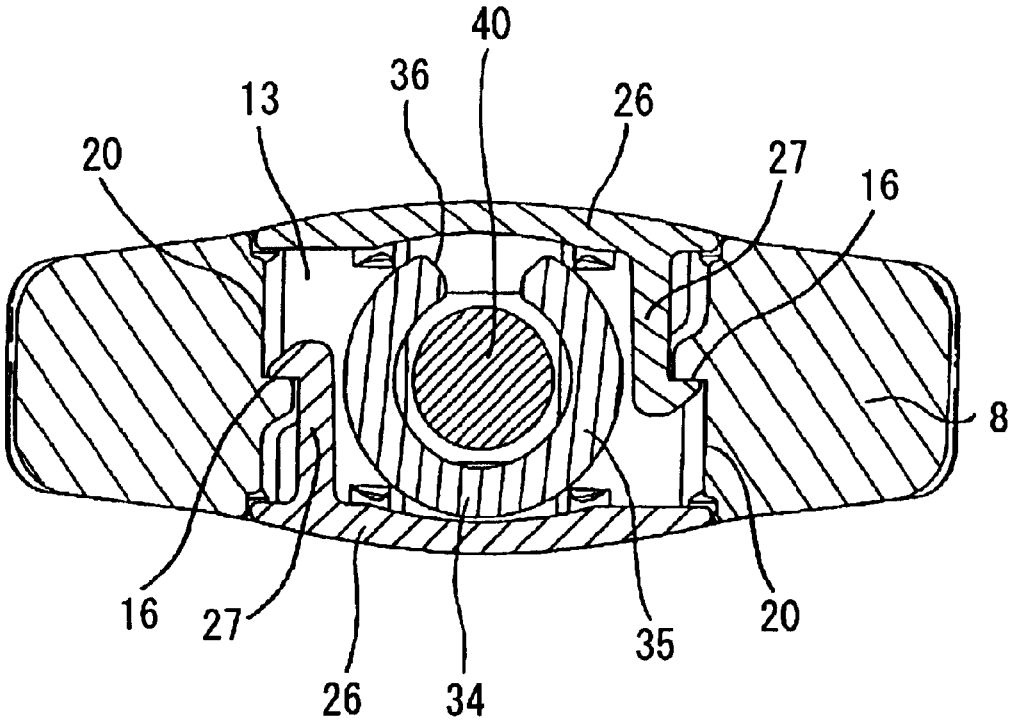
FIG. 10 is a horizontal cross section of the first member of the belt connector.

The retainer 34 and the cover 26 are attached to the body 8 of the first member 1 as shown in FIG. 9, where the C-shaped bearing 35 of the retainer 34 is fitted between the bulging head 42 of the rotary shaft 40 and the lower sides 23 on both sides of the groove 15 while being elastically deformed from one side and the rotation-stop projection 37 is fitted to the groove 15 to prevent rotation of the retainer 34. Next, in order to locate the cover 26 on the outside the retainer 34, the cover 26 is fitted to the front and back opening 14 of the accommodating portion 13 to conceal the rotary shaft 40 as shown in FIG. 10 to produce the belt connector.

[Third Embodiment]

Figure 12:
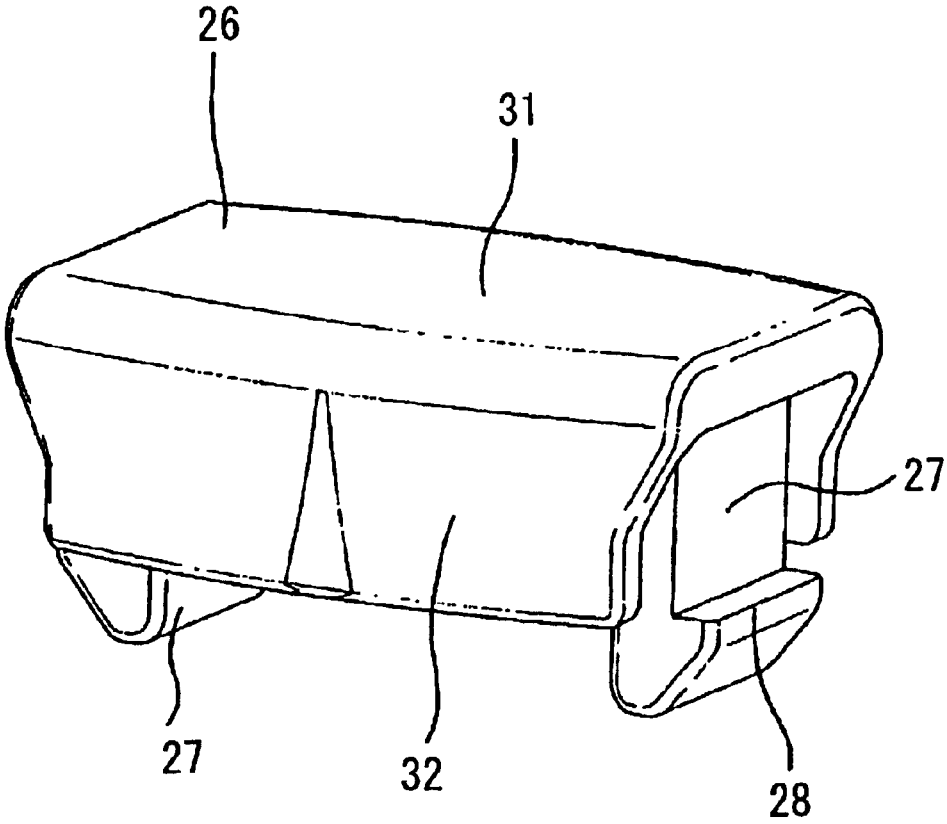
FIG. 12 is a perspective view showing a cover of the belt connector.
Figure 13:
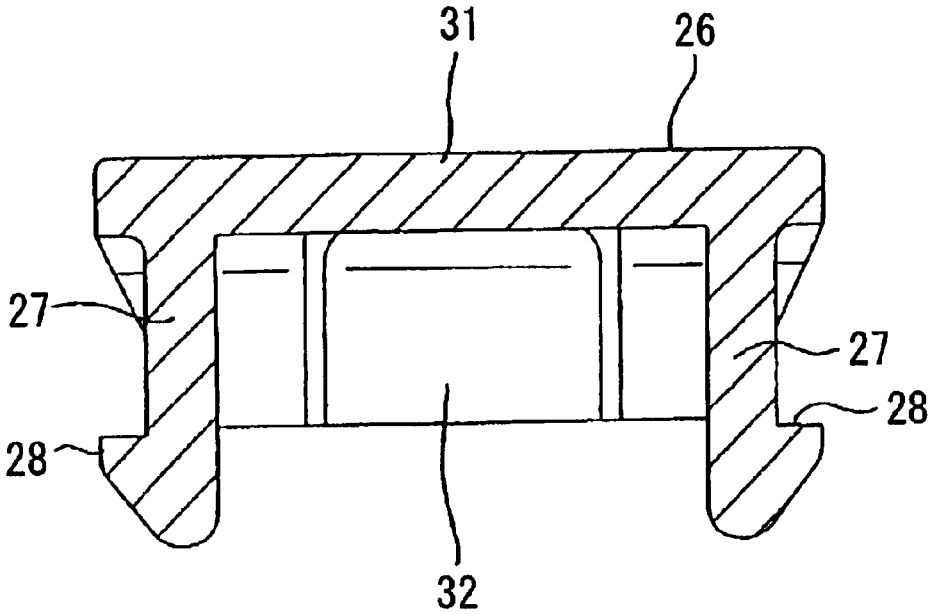
FIG. 13 is a longitudinal cross section showing a cover of the belt connector.
Figure 14:
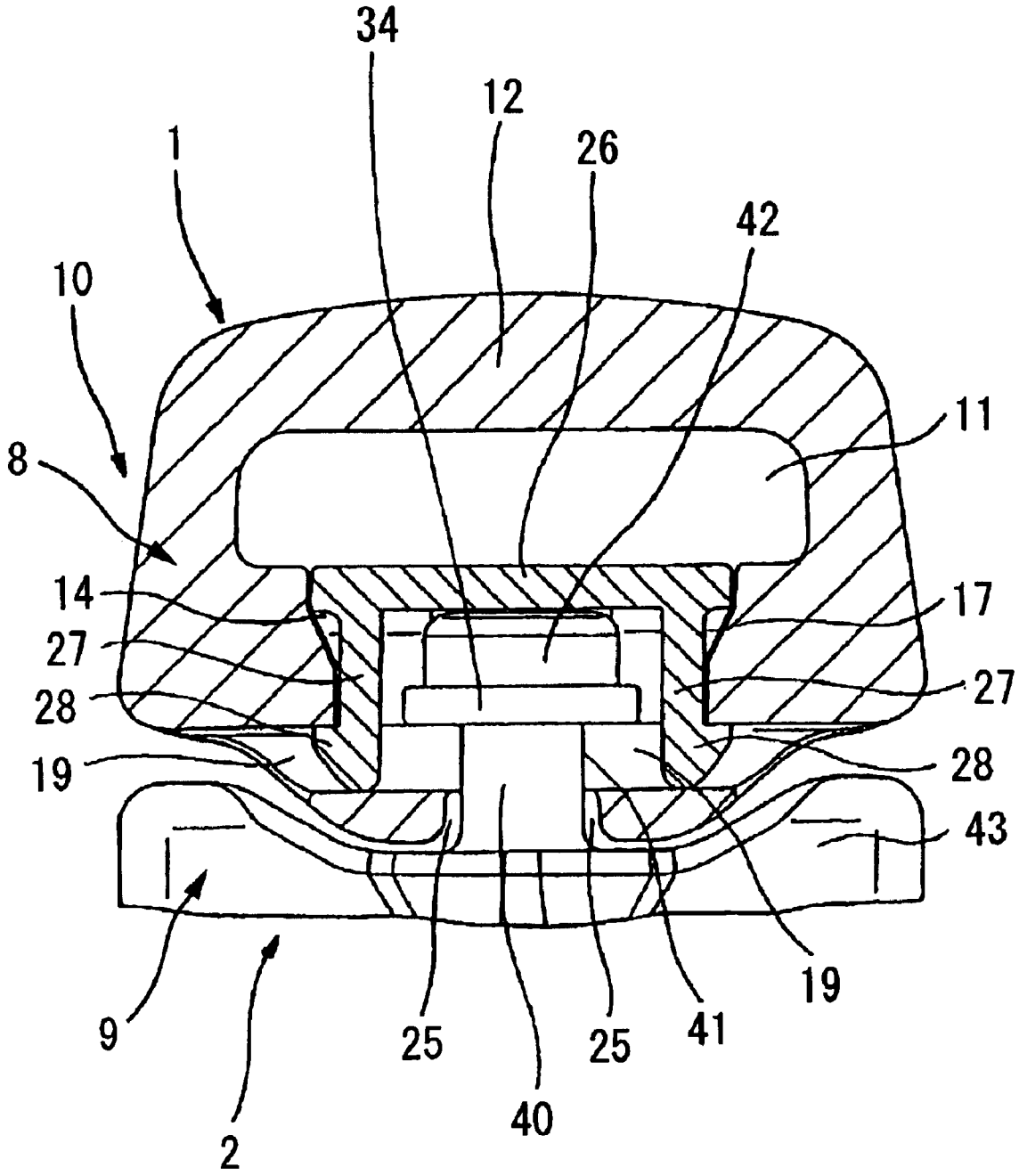
FIG. 14 is a partly sectioned front elevational view showing a primary portion of the belt connector.

The belt connector according to third embodiment of the present invention shown in FIGS. 11 to 14 is different from the above-described embodiments in the arrangement of the retainer 34 and the cover 26. As shown in FIG. 14, a concave portion 17 penetrating from the belt attachment hole 11 to the inside, i.e. toward the rotary shaft 40, is provided on the body 8 of the belt attachment 10 of the first member 1. The lower side of the body 8 is gently raised toward the body 9 of the second member 2, at which a core hole 19 for molding the rotary shaft 40 is formed. The core of the injection molding process is inserted to the concave portion 17 and a gap 25 around the rotary shaft 40 from front and back direction to mold a part of the neck portion 41 of the rotary shaft 40 and the bulging head 42. Further, Another core is inserted to the core hole 19 at the raised portion from right and left direction to form the rest of the neck portion of the rotary shaft 40.

Figure 11:
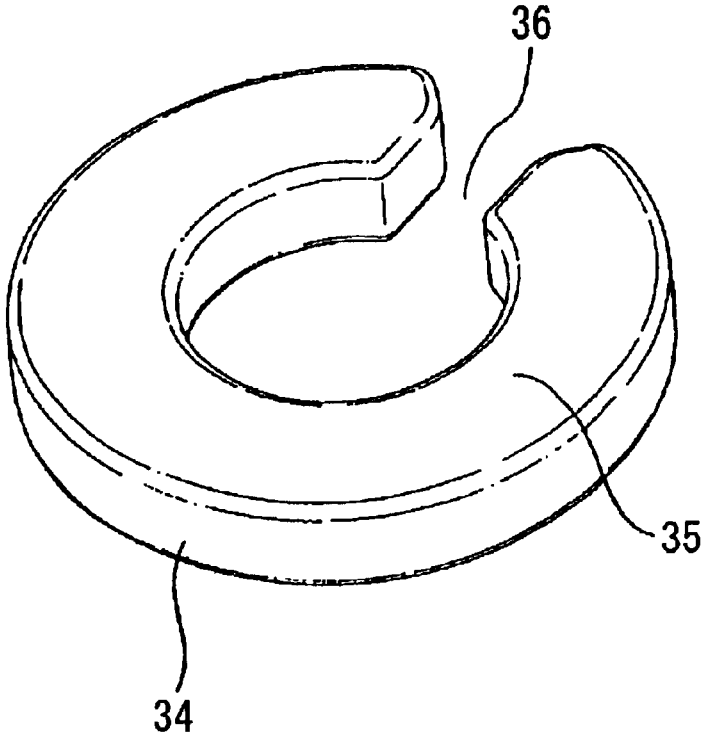
FIG. 11 is a perspective view of a retainer according to a third embodiment of the present invention.

The retainer 34 attached to the rotary shaft 40 has the C-shaped bearing 35 formed by providing the slit 36 to a part of a ring as shown in FIG. 11. The cover 26 covering the concave portion 17 has, as shown in FIGS. 12 and 13, an upper plate 31 to be aligned with the lower side of the attachment hole 11 of the belt attachment 10, a cover piece 32 provided on the front and rear sides of the upper plate 31 for covering the concave portion 17 from the front and back direction of the body 8, and engaging pieces 27 extending downward from the right and left sides of the upper plate 31 and having the engaging claw 28 at a distal end thereof to be engaged with the core hole 19. A gap is formed between the engaging piece 27 and the cover piece 32 for facilitating elastic deformation of the engaging piece 27.

After integrally injection-molding the first member 1 and the second member 2, the bearing 35 as the retainer 34 is fitted to be fixed from the slit between the bulging head 42 of the rotary shaft 40 and the lower side 23 of the concave portion 17 of the accommodating portion 13. Subsequently, the cover 26 is covered and pressed from the upper side of the concave portion 17 to engage the engaging claw 28 of the engaging piece 27 to the core hole 19 to produce the belt connector.

[Fourth Embodiment]

Figure 15:
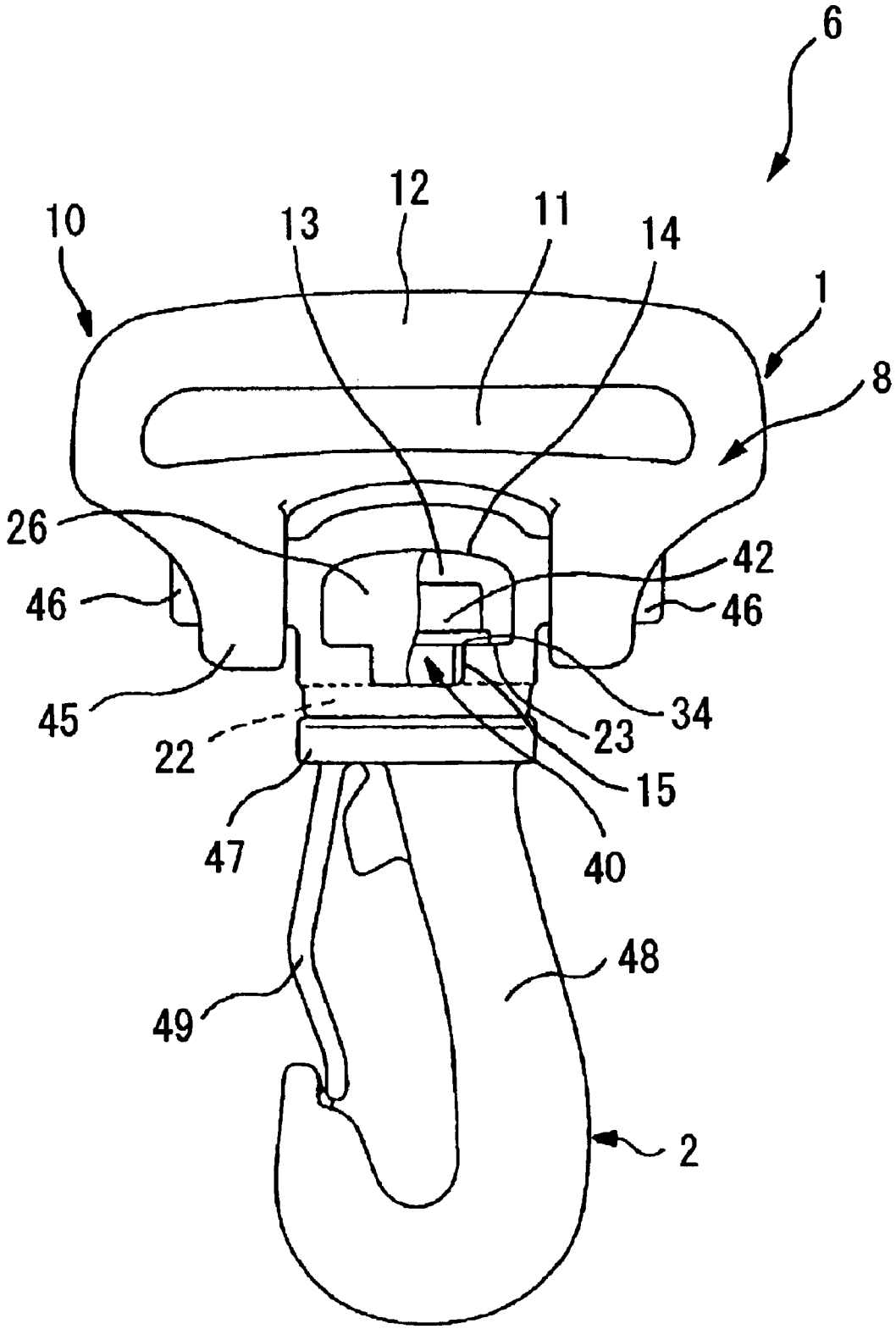
FIG. 15 is a front elevational view showing a hooking belt according to fourth embodiment of the belt connector of the present invention.

The belt connector according to fourth embodiment of the present invention shown in FIG. 15 is applied to a swivel hook. The swivel hook 6 has a first member 1 of which body 8 is rotatably supported by a belt attachment 10 and a second member 2 formed of a hook 48. The belt attachment 10 has a belt attachment hole 11 and a belt attachment bar 12. A leg 45 for supporting an axis 46 of the body 8 projects from both sides of the belt attachment 10, so that the body 8 is supported on a shaft hole of the leg 45 by the axis 46 on both sides thereof. The accommodating portion 13 is formed by an opening 14 of circular cross section penetrating in a direction orthogonal with the axis 46, and a concave groove 15 slightly wider than the diameter of the neck portion 41 of the rotary shaft 40 is provided at the center of the lower side of the accommodating portion 13. A concave groove 22 slightly wider than the diameter of the neck portion 41 of the rotary shaft 40 and orthogonal with the groove 15 is formed on the lower side of the body 8.

The hook 48 of the swivel hook 6 has a disk-shaped base 47 on the side of the belt attachment 10 and the rotary shaft 40 projects at the upper center of the base 47 to be attached to the body 8. In the swivel hook 6, the belt attachment 10 and the axis 46 of the body 8, and the accommodating portion 13 of the body 8 and the hook 48 are respectively integrally molded. During the molding process, the core is disposed at the front and back of the accommodating portion 13 and the groove 22 of the body 8 to form the bulging head 42 and a part of the neck portion 41 of the rotary shaft 40.

Further, core is disposed from both sides of the axis 46 and the leg 45 while the axis is supported and core is disposed from both sides of the concave groove 22 disposed on the lower side of the body 8 to form a part of the neck portion 41 of the rotary shaft 40.

The rotary shaft 40 disposed in the accommodating portion 13 of the molded body 8 is capable of vertical movement, thus causing shakiness. Accordingly, the retainer 34 having the C-shaped bearing 35 shown in FIG. 11 is fitted to the neck portion 41 between the bulging head 42 of the rotary shaft 40 accommodated in the accommodating portion 13 and the lower side 23 on both sides of the groove 15, and the cover 26 having curved surface is fitted to the outer opening 14 to prevent the shaky movement between the first member 1 and the second member 2.

[Fifth Embodiment]

Figure 16:
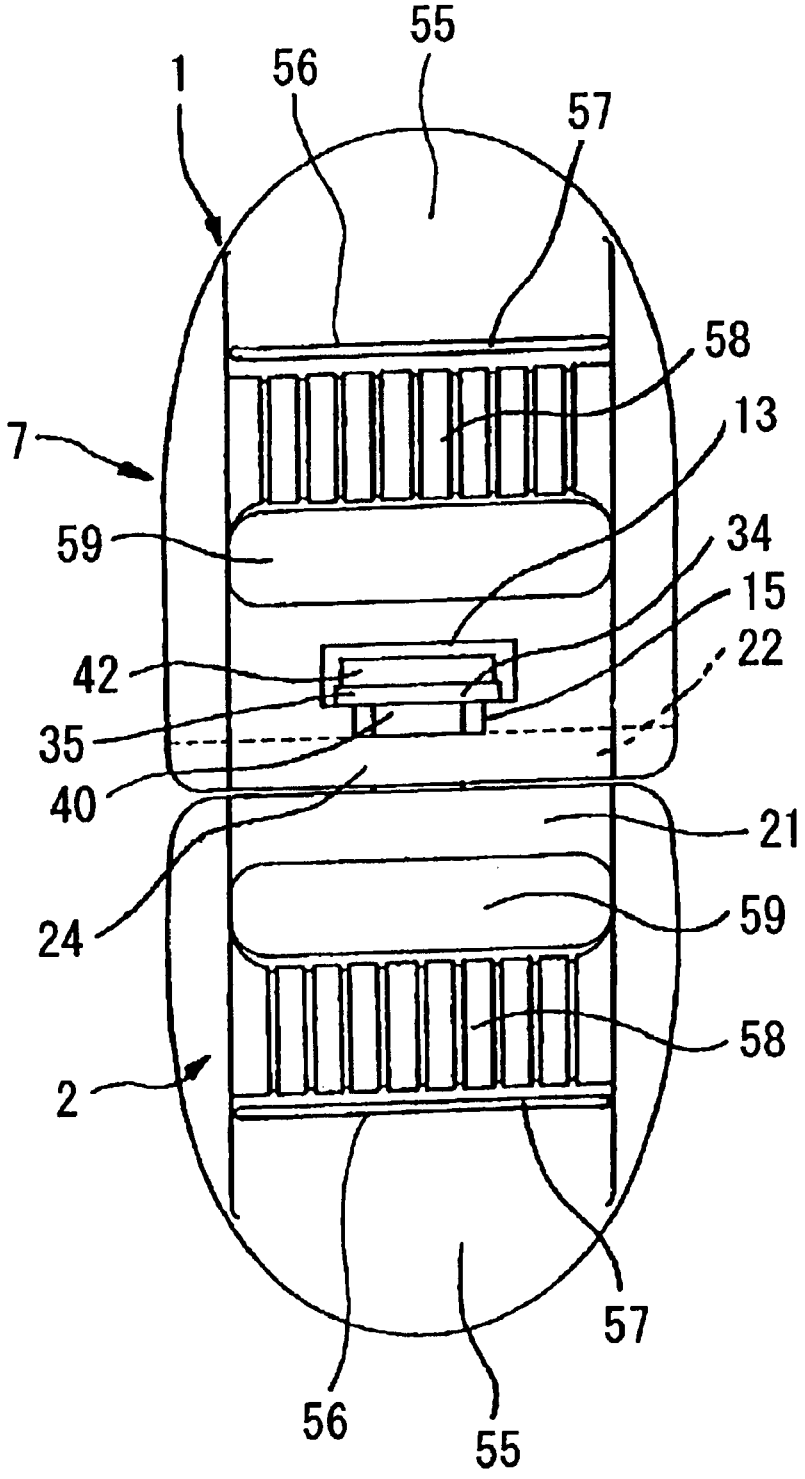
FIG. 16 is a rear elevational view of a belt adjuster according to fifth embodiment of the belt connector of the present invention.

The belt connector according to fifth embodiment of the present invention shown in FIG. 16 is applied to a belt adjuster. Both of the first member 1 and the second member 2 of the belt adjuster 7 have a belt adjusting mechanism. The first member 1 is of fat flat body having thickness corresponding at least to the size of the bulging head 42 of the rotary shaft 40, which has a belt insert hole 59 at the center thereof, a hook bar 58 adjacent to the belt insert hole 59 for hooking the belt, an engaging bar 55 opposing the hook bar 58 and having an engaging portion 56 for engaging the belt, and an engaging hole 57 between the engaging bar 55 and the hook bar 58 for the belt to be inserted, thereby being capable of adjusting the length of the belt. The accommodating portion 13 extends from the side of the belt insert hole 59 to the lower end of the first member 1. The concave groove 15 is provided on the lower end of the accommodating portion 13 and the core concave groove 22 is provided to the horizontal bar 24 at the lower side of the groove 15. When the first member 1 and the second member 2 are integrally molded, the core is inserted to the accommodating portion 13 and the groove 15 from the front and back sides thereof to form the bulging head 42 and a part of the neck portion 41 of the rotary shaft 40. Further, a core is disposed from both sides of the core concave groove 22 of the horizontal bar 24 to form the rest of the neck portion 41 of the rotary shaft 40.

On the other hand, the second member 2 is a fat flat body, which has a base bar 21 on an end thereof, a belt insert hole 59 adjacent to the base bar 21, a hook bar 58 adjacent to the insert hole 59 for hooking the belt, and an engaging bar 44 opposing the hook bar 58 and having an engaging portion 56 for engaging the belt on a side thereof, thereby adjusting the length of the belt. The rotary shaft 40 to be connected with the first member 1 projects from the center of the top side of the base bar 21.

In the belt adjuster 7 of which first member 1 and second member 2 are integrally molded, the retainer 34 having the C-shaped bearing 35 is fitted to the neck portion 41 of the rotary shaft 40 between the bulging head 42 of the rotary shaft 40 in the accommodating portion 13 of the first member 1 and the lower side 23 of the accommodating portion 13, thereby restraining the shakiness between the first member 1 and the second member 2.

In order to attach the belt to the belt adjuster 7, in the first member 1, an end of the belt is: inserted to the belt insert hole 59 through the backside of the engaging bar 55; wound around the belt hook bar 58; guided to the engage hole 57 to be bent at the engaging portion 56; drawing from the backside of the engaging bar 55 superposing the remaining part of the belt; and drawing appropriately to adjust the length of the belt, which is engaged and fixed at the engaging portion 56 of the engaging bar 55. Further, after winding an object by the end of the belt, the end of the belt is: inserted to the belt insert hole 59 through the backside of the engaging bar 55; wound around the belt hook bar 58; guided to the engage hole 57 to be bent at the engaging portion 56; drawing from the backside of the engaging bar 55 superposing the remaining part of the belt; and drawing appropriately to adjust the length of the belt, which is engaged and fixed at the engaging portion 56 of the engaging bar 55.

Though both of the first member 1 and the second member 2 have belt-length adjusting mechanism in the above-described embodiment, the belt insertion mechanism of either one of the first member and the second member may be simplified, here the belt insert hole may be provided at the center of the member and an attachment bar for attaching the belt may be provided on the outside of the insert hole. An end of the belt may be wound around the attachment bar to be fixed by sewing or rivet and the other end of the belt may be inserted to the belt-length adjusting mechanism provided to the other member.

[Sixth Embodiment]

Figure 17:
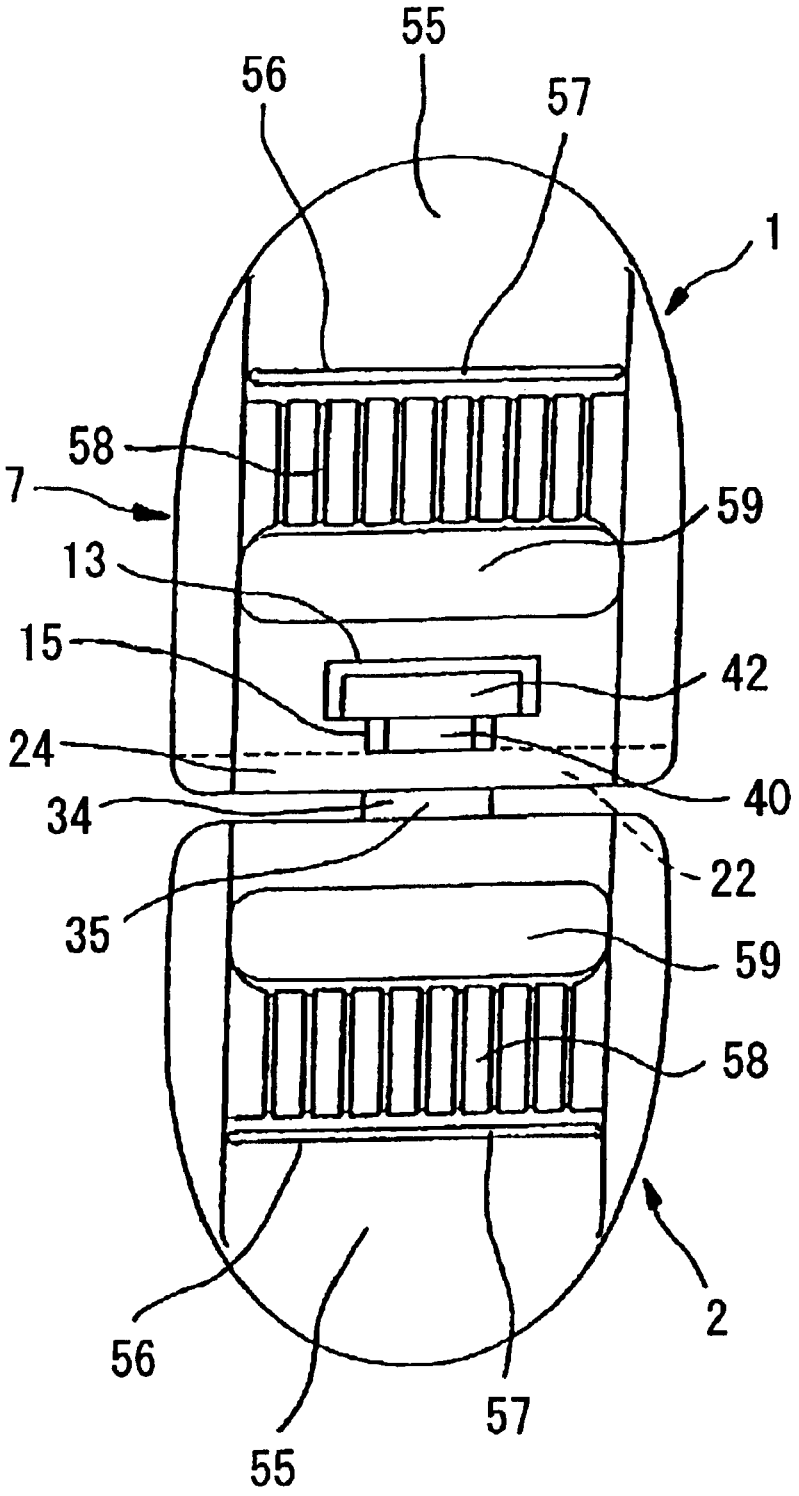
FIG. 17 is a rear elevational view of a belt adjuster according to sixth embodiment of the belt connector of the present invention.
Figure 18:
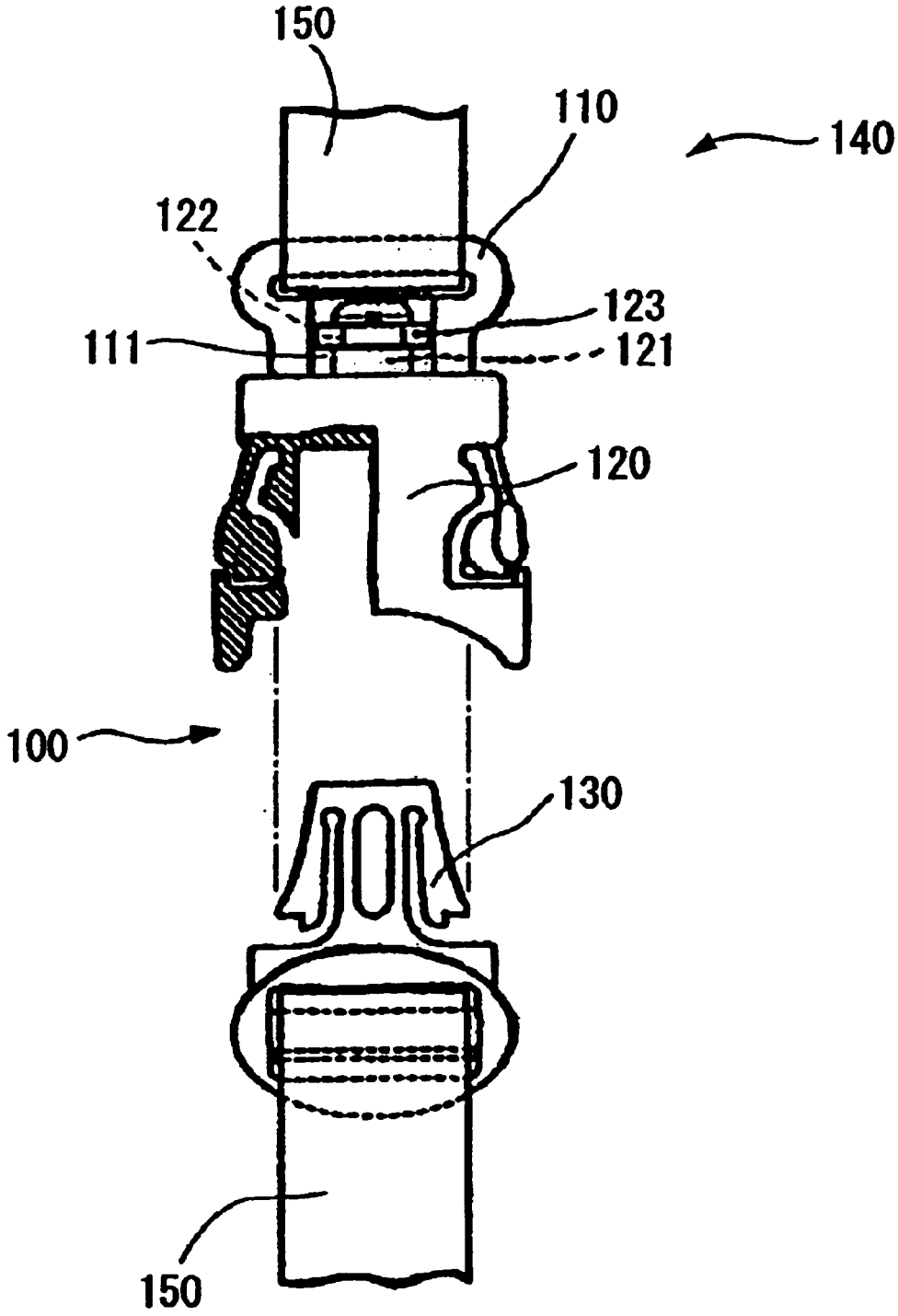
FIG. 18 PRIOR ART
FIG. 18 is a front elevational view showing a male-female buckle of a conventional belt connector.
Figure 19:
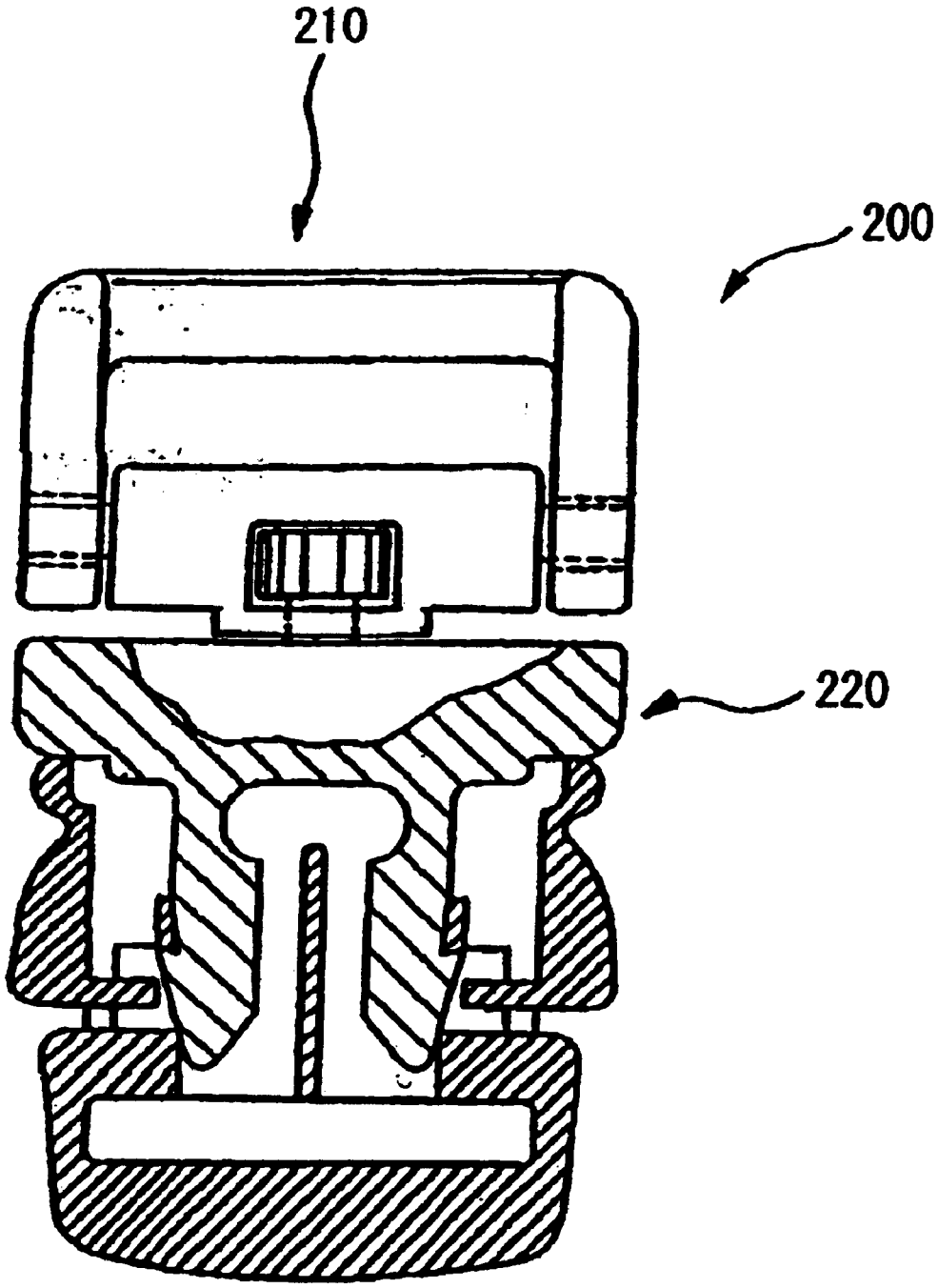
FIG. 19 PRIOR ART
FIG. 19 is a front elevational view showing a swivel hook of another conventional belt connector.

The belt connector of sixth embodiment of the present invention shown in FIG. 17 is applied to a belt adjuster as in the above embodiment. The belt adjuster of the present embodiment has approximately the same arrangement as in the above belt adjuster, which is different only in that the bearing 35 as the retainer 34 is not disposed between the bulging head 42 of the rotary shaft 40 in the accommodating portion 13 of the first member 1 and the lower side 23 on both sides of the groove 15, but that the retainer 34 having the C-shaped bearing 35 is fitted to the neck portion 41 of the rotary shaft 40 disposed between the first member 1 and the second member 2 to eliminate shakiness between the first member 1 and the second member 2. The rest of the arrangement is the same as the belt adjuster of the above embodiment, of which description is omitted.

What is claimed is:

1. A belt connector, comprising:

a first member having a first body provided with an accommodating portion for accommodating a rotary shaft; and a second member having a second body from which the rotary shaft is projected, at least one of the first member and the second member being provided with a belt attachment, the first member and the second member being connected in a rotatable manner, wherein the first member and the second member are integrally molded so that the rotary shaft does not come off from the accommodating portion, and wherein a retainer for restricting relative movement of the first member and the second member in axial direction of the rotary shaft is attached to the rotary shaft.

2. The belt connector according to claim 1, wherein the retainer is fitted to the rotary shaft where the rotary shaft is exposed between the first member and the second member.

3. The belt connector according to claim 1, wherein the rotary shaft has a neck portion and a bulging head formed at a distal end of the neck portion, and wherein the retainer is located between the lower side of the bulging head and the inner circumference of the accommodating portion facing the lower side of the bulging head.

4. The belt connector according to claim 1, wherein the retainer is formed in a bearing having a semicircular distal end.

5. The belt connector according to claim 1, wherein a cover for concealing the rotary shaft in the accommodating portion is fitted to the accommodating portion.

6. The belt connector according to claim 5, wherein the accommodating portion has an opening opening to the front and back sides of the first body, the opening being covered with a pair of covers.

7. The belt connector according to claim 6, wherein the pair of covers are of identical shape.

8. The belt connector according to claim 5, wherein the belt attachment has a belt attachment hole, the belt attachment hole being provided with a concave portion intercommunicating with the accommodating portion, and wherein the cover is fitted to the concave portion so that the rotary shaft is accommodated therein.

9. The belt connector according to claim 5, wherein the retainer and the cover are integrally molded to be connected.

10. The belt connector according to claim 1, wherein the retainer is formed in a bearing having a slit on a part thereof.

11. The belt connector according to claim 10, wherein the retainer has a rotation-stop projection, the rotation-stop projection capable of being fitted to a groove provided to the accommodating portion.

12. The belt connector according to claim 1, wherein a thick portion is provided on the second body by thickening a base of the second body from which the rotary shaft is projected.

13. The belt connector according to claim 1, wherein the belt attachment is provided on either one of the first member and the second member, and wherein a third member capable of attachment and detachment through an engaging mechanism is provided on the other, the third member being provided with another belt attachment.

14. The belt connector according to claim 1, wherein the belt attachment is provided on either one of the first member and the second member, and wherein the other is made of a swivel hook.

15. The belt connector according to claim 1, wherein a mechanism for adjusting belt length is provided on either one of the first member and the second member.

16. The belt connector according to claim 1, wherein a bulging portion having an arc-shaped periphery is formed on an inner circumference of a hole for a belt to be inserted, so that the hole for the belt to be inserted has wider space on both sides thereof and narrow space at the central portion thereof.

17. The belt connector according to claim 1, wherein the rotary shaft has a neck portion and a bulging head formed on the distal end of the neck portion, wherein the accommodating portion has a slit for the neck portion to be inserted, and wherein the bulging head is incapable of going through the slit.

* * * * *